US008636578B2

(12) United States Patent
Olsen

(10) Patent No.: US 8,636,578 B2
(45) Date of Patent: Jan. 28, 2014

(54) MYSTERY JACKPOT WITH BINGO GAME TRIGGER

(75) Inventor: Eric Olsen, Henderson, NV (US)

(73) Assignee: Olsen Gaming Inc., Las Vegas, NV (US)

( * ) Notice: Subject to any disclaimer, the term of this patent is extended or adjusted under 35 U.S.C. 154(b) by 125 days.

(21) Appl. No.: 13/324,964

(22) Filed: Dec. 13, 2011

(65) Prior Publication Data

US 2013/0150141 A1 Jun. 13, 2013

(51) Int. Cl.
*A63F 9/24* (2006.01)

(52) U.S. Cl.
USPC ..... 463/19; 463/16; 463/26; 463/42; 273/269; 273/138.1

(58) Field of Classification Search
USPC ..... 463/40–43, 16–22, 25–28; 273/269, 273/138.1, 139, 138.2
See application file for complete search history.

(56) References Cited

U.S. PATENT DOCUMENTS

| | | | | |
|---|---|---|---|---|
| 7,481,707 | B1 * | 1/2009 | Luciano et al. | 463/19 |
| 7,874,907 | B2 * | 1/2011 | Lozano et al. | 463/19 |
| 7,946,915 | B2 * | 5/2011 | Cannon | 463/19 |
| 7,959,509 | B2 * | 6/2011 | Saffari et al. | 463/27 |
| 8,192,279 | B2 * | 6/2012 | Saffari et al. | 463/27 |
| 2005/0059467 | A1 * | 3/2005 | Saffari et al. | 463/19 |
| 2009/0011814 | A1 * | 1/2009 | Lozano et al. | 463/19 |
| 2012/0088576 | A1 * | 4/2012 | Shepherd et al. | 463/26 |

* cited by examiner

*Primary Examiner* — William Brewster
*Assistant Examiner* — Alex F. R. P. Rada, II
(74) *Attorney, Agent, or Firm* — Lightbulb IP, LLC

(57) ABSTRACT

A mystery-bingo jackpot provides a bingo triggered jackpot with a maximum or upper limit. In one or more embodiments, the jackpot is guaranteed to be paid out before the jackpot increments beyond the upper limit. This allows the upper limit to published to entice players to play one or more base games associated with the jackpot. A plurality of trigger values may be generated to trigger bingo ball draws. The trigger values may be between a lower limit and the upper limit to ensure that a winning outcome occurs before the upper limit is reached. One or multiple jackpots may be offered.

19 Claims, 5 Drawing Sheets

MYSTERY JACKPOT WITH BINGO GAME TRIGGER

BACKGROUND OF THE INVENTION

1. Field of the Invention

The invention relates to jackpot systems and in particular to a mystery jackpot with a bingo type trigger.

2. Related Art

A jackpot or bonus award is often used to both reward and entice players to wager at one or more base games. The base games may be various wagering games, such as slot games or card games. The jackpot or bonus is generally provided to a player of a base game when the player meets a particular criteria at the base game, such as by wagering a particular amount and achieving a particular game outcome.

Various types of jackpots or bonuses exist. One type of jackpot or bonus is known as a progressive jackpot. Progressive jackpots are traditionally driven by occurrences at their associated base games. For example, traditional jackpots are typically funded by the wagers received by their base games, and the payout of these jackpots are based on the game outcomes achieved at the base games.

As such, such jackpots are limited by the base games to which they are associated. To illustrate, a traditional progressive jackpot might be associated with Class-III gaming machines, such as reel-type slot machines. Thus, in this exemplary case, funding and jackpot payout would occur based on the operation of a Class-III game.

From the discussion that follows, it will become apparent that the present invention addresses the deficiencies associated with the prior art while providing numerous additional advantages and benefits not contemplated or possible with prior art constructions.

SUMMARY OF THE INVENTION

A mystery-bingo jackpot is disclosed herein. The mystery-bingo jackpot may utilize a bingo game as its triggering mechanism, while providing an upper limit before which the mystery-bingo jackpot is awarded.

The mystery-bingo jackpot may have various configurations. In one exemplary embodiment for example, a mystery-bingo jackpot controller may be provided. Such a controller may comprise one or more memory devices storing a jackpot award amount, a mystery-bingo winning outcome, and an upper limit, and a lower limit. One or more random number generators may be configured to generate a plurality of trigger values between the upper limit and the lower limit.

One or more processors may also be provided. The processors may be configured to increment the jackpot award amount a particular amount, update a global bingo card with a drawn bingo ball number if the jackpot award amount meets or exceeds one of the plurality of trigger values, and compare the updated global bingo card to the winning outcome. A payout of the jackpot award amount may be initiated if the updated global bingo card contains the winning outcome. The quantity of trigger values may be set such that the winning outcome must occur before the jackpot award amount reaches the upper limit.

One or more communication devices may be provided to receive wager information from one or more gaming machines, the wager information indicating the particular amount in which to increment the jackpot award amount. A display may also be provided. The display may present the jackpot award amount, the global bingo card, and the upper limit via one or more electronic screens. This permits players to see the upper limit or must hit by value. Players may then be enticed to wager.

It is noted that the processors may be further configured to associate a bingo ball number with each of the plurality of trigger values. In such case, the drawn bingo ball number may be the bingo ball number associated with the one of the plurality of trigger values that is met or exceeded. Alternatively, a ball draw apparatus may be provided to randomly select the drawn bingo ball number.

The processors may be configured to reset the jackpot award amount to a predefined base amount if the updated global bingo card contains the winning outcome, the predefined base amount stored in the memory devices.

The mystery-bingo jackpot controller may support multiple jackpots of different types. In such case for example, the memory devices may also store one or more additional winning outcomes having associated jackpot award amounts. The processors may then be further configured to initiate a payout of the associated jackpot award amount when the updated global bingo card contains at least one of the additional winning outcomes.

In another exemplary embodiment, a mystery-bingo jackpot system may comprise a display configured to present a global bingo card, a first jackpot award, a first must hit by value, and a first winning outcome. The first winning outcome may comprise a set of bingo ball numbers.

The system may also include a plurality of first trigger values between the first upper limit and the first lower limit and one or more processors. The processors may be configured to increment the first jackpot award, update the global bingo card with a drawn bingo ball number when the first jackpot award meets or exceeds one of the plurality of first trigger values, and compare the updated global bingo card to the first winning outcome. The updated global bingo card may be presented on the display. The first jackpot award may be paid when the updated global bingo card contains the first winning outcome. The quantity of first trigger values may be set such that the winning outcome must occur before the jackpot award amount reaches the upper limit. It is noted that the largest of the plurality of first trigger values defines the first must hit by value.

The mystery-bingo jackpot system may also include a plurality of second trigger values between a second upper limit and a second lower limit. In such case, the processors may be further configured to increment a second jackpot award, compare the updated global bingo card to the second winning outcome, and pay a second jackpot award when the updated global bingo card contains the second winning outcome. The quantity of second trigger values may be set such that the winning outcome must occur before the jackpot award amount reaches the upper limit. It is noted that the display is further configured to present the second upper limit and the second jackpot award.

One or more gaming machines configured to receive wagers for one or more base games may be part of the mystery-bingo system. The gaming machines may generate the wager information based on the received wagers.

A bingo ball draw apparatus configured to randomly select bingo ball numbers may also be provided. If provided, the drawn number used by the system may be one of the randomly selected bingo ball numbers. It is noted that the bingo ball draw apparatus may be configured to randomly select physical bingo balls. In such case, the drawn number may be a bingo ball number from one of the randomly selected physical bingo balls.

Various methods relating to a mystery-bingo jackpot are also disclosed herein. For example, a method for awarding a mystery-bingo jackpot with a jackpot controller may be provided. Such method may comprise selecting a plurality of trigger values between a lower limit and an upper limit and storing the plurality of trigger values to one or more memory devices of the jackpot controller, receiving wager information with a communication device (the wager information identifying an increment value), and incrementing the mystery-bingo jackpot's amount by the increment value.

A drawn bingo ball number may be included in a global bingo card if the amount of the mystery-bingo jackpot meets or exceeds one of the plurality of trigger values. The global bingo card may then be compared to a winning outcome, and the amount of the mystery-bingo jackpot may then be awarded if the global bingo card contains the winning outcome.

The amount of the mystery-bingo jackpot may be awarded to a player whose wager caused the amount to meet or exceed the one of the plurality of trigger values. The quantity of the plurality of trigger values may be set such that the winning outcome must occur before the jackpot award amount reaches the upper limit. The lower limit and the upper limit may be received at the mystery-bingo jackpot controller.

A plurality of new trigger values between the lower limit and the upper limit may be selected and stored in the memory devices of the jackpot controller after the mystery-bingo jackpot amount has been awarded. The mystery-bingo jackpot may then be reset and/or awarded again using the new trigger values.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The components in the figures are not necessarily to scale, emphasis instead being placed upon illustrating the principles of the invention. In the figures, like reference numerals designate corresponding parts throughout the different views.

DETAILED DESCRIPTION OF THE PREFERRED EMBODIMENTS

Figure 1A:
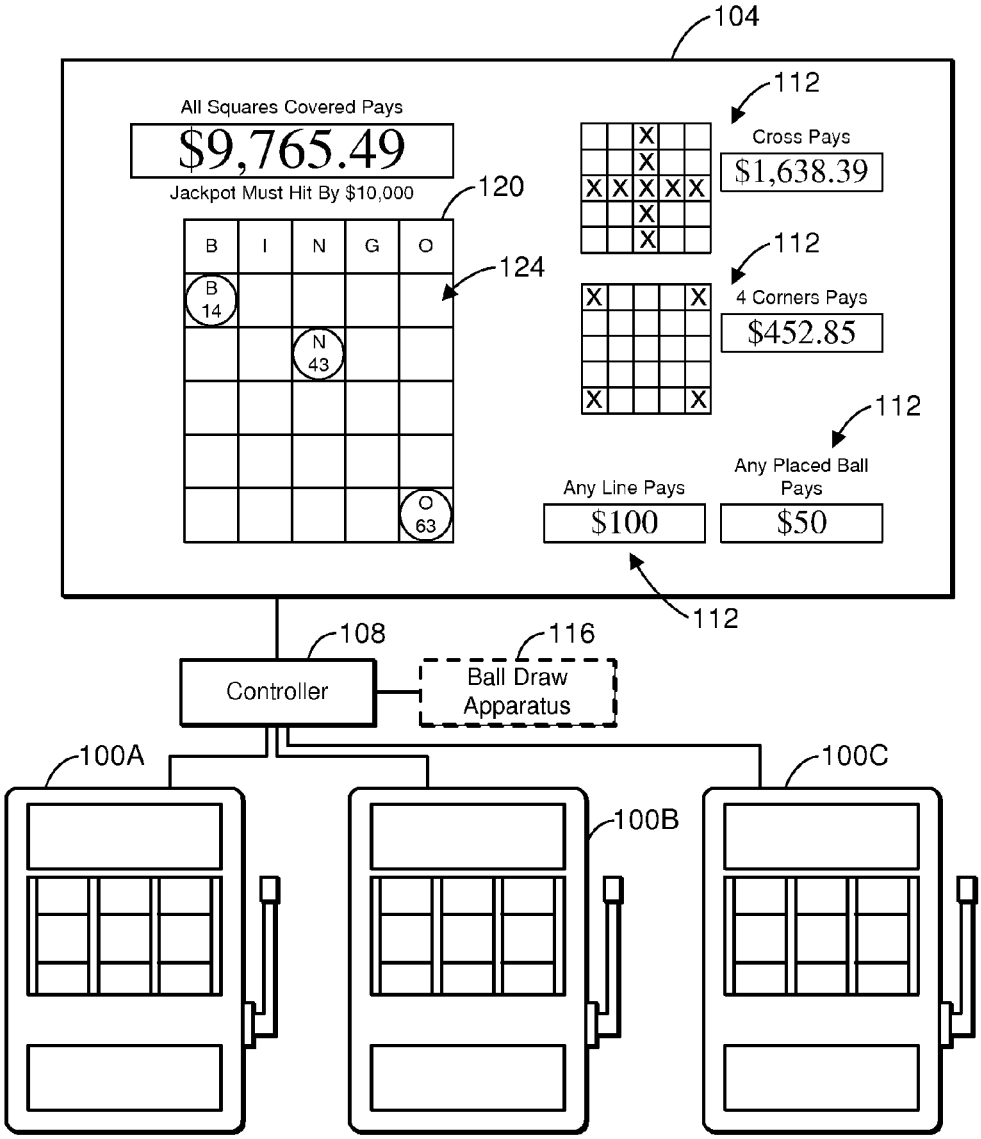
FIG. 1A is a block diagram illustrating an exemplary mystery-bingo jackpot system.

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

In general, the mystery jackpot with bingo game trigger (hereinafter "mystery-bingo jackpot") disclosed herein utilizes a unique triggering mechanism to determine jackpot winners, while preserving the benefits of mystery jackpots. Namely, the mystery-bingo jackpot may utilize a bingo game as its triggering mechanism to award the jackpot. This is advantageous in that players participate in not just a base wagering game, but also a bingo game for the jackpot award. This adds to the excitement and enticement of the wagering game and provides a bonus award, should the player win the mystery-bingo jackpot.

There are numerous gaming jurisdictions where only Class-II gaming is permitted. Class-II wagering games are based on traditional games, such as lottery and bingo. The mystery-bingo jackpot's use of a Class-II wagering game (e.g., bingo) as a triggering mechanism is thus another advantage in that it allows the mystery-bingo jackpot to be used in such jurisdictions. In addition, as will be described further below, the mystery-bingo jackpot provides the desirable characteristics of a traditional random or mystery jackpot to players and gaming establishments.

Traditional mystery jackpot systems link a plurality of gaming devices to one or more shared jackpot pools. Wagers of the underlying games are monitored, and a contribution is calculated and added to the progressive jackpot pool for each wager. For each jackpot pool, a random jackpot award is secretly chosen between two value limits, a minimum and maximum limit. The jackpot pools are displayed to the players. In addition, the maximum limit is often posted with the jackpot value, so players know that as they continue wagering, the winning event draws nearer. If and when the jackpot values approaches the maximum limit, players understand the winning trigger event is about to hit. This is because in traditional systems, the jackpot winner is simply the player whose wager pushes the jackpot value to equal or exceed the secret value triggers the random jackpot.

In contrast, the mystery-bingo jackpot is driven by the underlying game of bingo, while preserving the characteristics of a mystery jackpot. For example, as will be described further below, the mystery-bingo jackpot may progress using an increment rate from underlying wagers of the gaming machines. This allows the overall link payback to be adjustable by the gaming establishment or other operator. Typically, the upper limit of the mystery-bingo jackpot will be available for presentation to players, so that as the value of the jackpot increases, the increased likelihood for a jackpot winner is obvious to the players. In fact, in one or more embodiments, the jackpot award is guaranteed to be paid before the mystery-bingo jackpot's upper limit is reached.

A traditional bingo game is random, and as such, provides no certain way to determine, or even control, when a winning outcome will be achieved. The ability to post an upper limit is impossible without modifying the probabilities of the underlying bingo game (which could be done in some embodiments of the mystery-bingo jackpot). However, modifying the probabilities of bingo means it is no longer the game of bingo, and therefore may not be deemed legal for Class-II gaming.

The mystery-bingo jackpot will now be described with regard to FIGS. 1A-1B. In general, and as will be described further below, the mystery-bingo jackpot may reward players at its base games with bingo ball draws to fill in the global bingo card 120. The player that causes the global bingo card 120 to have a winning outcome will win the award associated with that outcome.

As can be seen, the mystery-bingo jackpot may offer a "must hit by" value or limit. This is because the mystery-bingo jackpot's awards may be configured such that they pay out randomly and before a predefined upper limit is reached, as will be described further below. This is advantageous in that it allows the upper limit to be known to players and to be published for players. This also drives increased play at base games as players realize a jackpot is about to be awarded.

The mystery-bingo jackpot system may have various configurations. For instance, as shown, the mystery-bingo jackpot system comprises a controller 108 and a display 104. The mystery-bingo jackpot system could also include or be in communication with one or more gaming machines 100, where its base games may be played.

In one or more embodiments, the display 104 may be a public display configured to present mystery-bingo jackpot status, awards, winning outcomes, and other information. The display 104 may have an increased size to make such information readily visible. It is noted that there may be a plurality of displays 104 mounted throughout a gaming establishment. In addition, the display 104 or information thereon may be represented electronically, such as by being presented on individual gaming machines or devices.

Figure 1B:
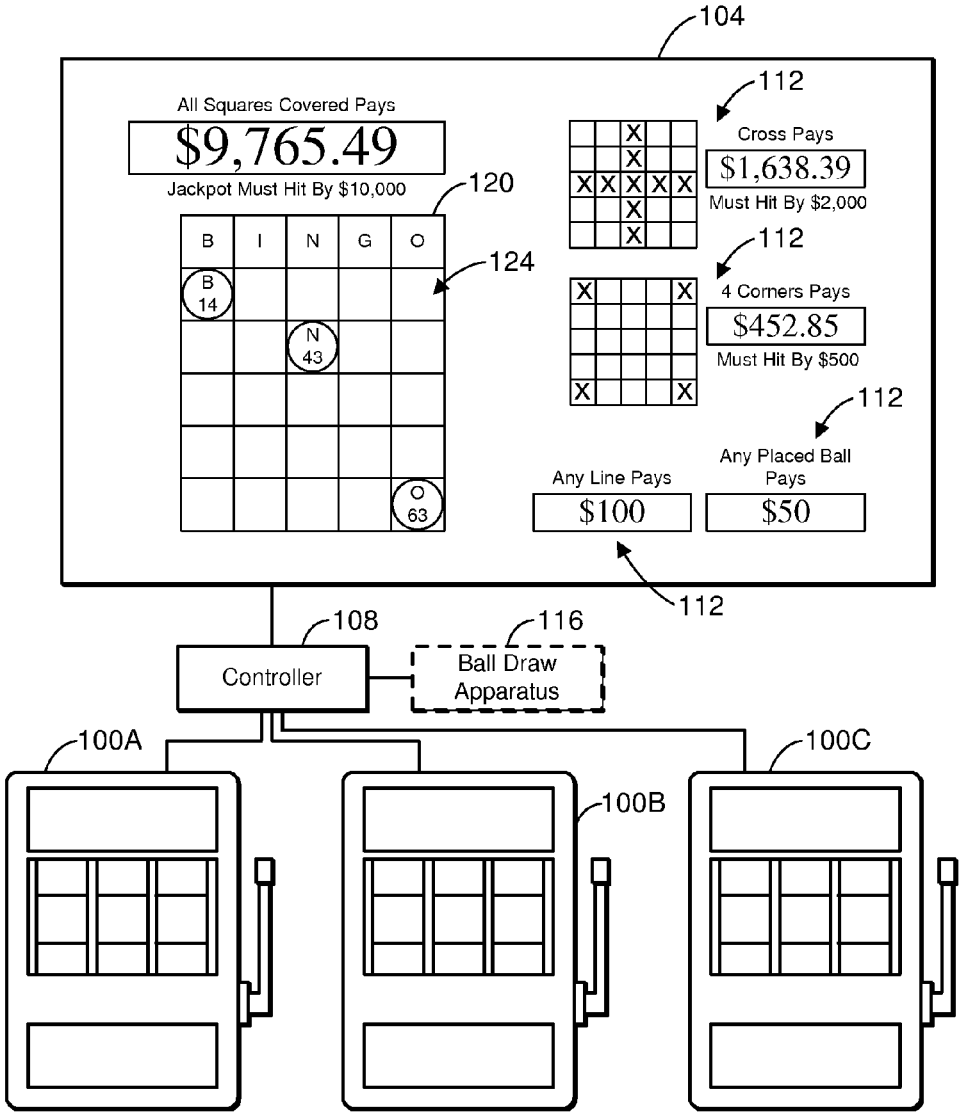
FIG. 1B is a block diagram illustrating an exemplary mystery-bingo jackpot system.

The exemplary display 104 of FIGS. 1A-1B illustrate the information that may be presented to players. As can be seen, various jackpot award amounts, including that of the mystery-bingo jackpot, may be shown along with an associated winning outcome. This is to notify players what they will win if they achieve one of the winning outcomes. For example, "all squares covered" would pay a mystery-bingo jackpot award of $9,765.49, a "cross" pays a progressive award of $1,638.39, and "four corners" pays a progressive award of $452.85. It is noted that other awards may be presented (and paid out) as well. For instance, as shown, achieving an "any line" outcome may pay a fixed award of $100, while an "any placed ball" outcome may pay a fixed award of $50.

As can also be seen, the winning outcomes may be shown and/or described in text or with representative bingo cards 112. A "must hit by" value may also be presented to indicate to players the upper limit of a mystery-bingo jackpot. It is noted that this also helps indicate that the jackpot is a mystery-bingo jackpot. In addition, the number of various jackpots offered, the amount of the jackpot(s), and the number and placement of previously drawn balls may be shown on the display 104 in some embodiments.

The display 104 will generally depict bingo cards in a 25 square arrangement, such as shown. It is contemplated that other configurations could be used as well. For example, square, rectangular or other shaped configurations may be used. In addition or alternatively, fewer or additional squares or spots 124 may be provided. A global bingo card 120 may show the current state of a mystery-bingo jackpot, such as by showing which spots 124 on the global bingo card have been marked. Players can compare the global bingo card 120 to winning outcomes to determine how close or if the jackpot has been won. The global bingo card 120 reveals the status of the mystery-bingo jackpot in this manner.

The display 104 itself may comprise one or more electronic displays, such as LCD, OLED, LED, or other screens. This allows information on the display 104 to be easily changed. For instance the jackpot award amounts, the state of the global bingo card, and the winning outcomes may be changed automatically as events occur. It is contemplated that separate electronic screens or displays may be used to present various jackpot award amounts, must hit by values, winning outcomes, representative bingo cards 112, or the global bingo card 120. Previous jackpot payouts may be presented as well. For example, a previously paid jackpot could be presented by its payout about and a "jackpot paid" or similar notification on the display 104. In some embodiments, the representative bingo cards 112 may display which spots 124 need to be covered to win and indicate which of those spots have already been covered (or not covered).

Portions of the display 104 could be static in some embodiments. For example, in one embodiment, only the global bingo card 120 and progressive award amounts may be presented via an electronic display, with the other mystery-bingo jackpot information being displayed statically such as by being printed on a portion of the display 104. It is contemplated that in lieu of an electronic displays one or more mechanical display apparatuses could be used, such as to rotate numbers or other information into and out of view.

The display 104 may be in communication with the mystery-bingo jackpot system's controller 108 in one or more embodiments. In this manner, information on the display 140 may be updated by the controller. For example, the status of the global bingo card 120 may be updated as bingo balls are drawn. In addition, announcements of jackpot winnings, changes to progressive award amounts, or changes to winning outcomes may be updated by the controller 108. Since the controller 108 may be in communication with the gaming machines 100, this information may be updated in real time or near real time. To illustrate, an award amount for a winning outcome may be increased as wagers are accepted at one or more of the gaming machines 100.

As alluded to, the mystery-bingo jackpot controller 108 may control or operate one or more mystery-bingo jackpots, as well as fixed, progressive or other jackpots if desired. As will be detailed below, the controller 108 may receive input from base games and other sources and provide various outputs, such as output indicating the value of one or more jackpot awards, the current state of the global bingo card, and whether a winning outcome has been achieved.

The mystery-bingo jackpot controller 108 may support an input/output control function through which the jackpot's configuration and settings may be made or modified. For example, a base amount, a lower limit and an upper limit may be set by the operator for each mystery-bingo jackpot offered. In general, the low and upper limit will define the range between which a mystery-bingo jackpot may be awarded. If the amount of a particular mystery-bingo jackpot is not within this range, then the mystery-bingo jackpot may not be awarded in one or more embodiments. In addition, as will be described further below, the mystery-bingo jackpots provided by the mystery-bingo jackpot system will typically always be awarded before the upper limit of a particular jackpot is reached. This preserves the characteristics of a mystery jackpot while incorporating a bingo game trigger.

The base amount may be an amount that a jackpot may be set to after it has been paid out. This amount may be zero but will typically be an amount larger than that to entice further play at the mystery-bingo jackpot's base games.

The operator may also set other parameters such as increment rate, which is the amount contributed to a jackpot from each wager. Each mystery-bingo jackpot may have its own increment rate or may share the same increment rate. It is contemplated that input and output may occur through various user interface devices such as keyboards, buttons, switches, pointing devices, touch screens, and display screens. In addition, in some embodiments, the controller 108 may have a network or other communication interface to allow configuration from a remote terminal or other external device.

In one or more embodiments, the parameters might include selection or configuration of winning outcomes. For example, the operator may select from a plurality of awards (bingo outcomes) to configuring the mystery-bingo jackpot. The mystery-bingo jackpot system may generate a selection of awards for the operator to select from. The ability to select in this manner is beneficial in that it allows the operator to create its own games.

Figure 2A:
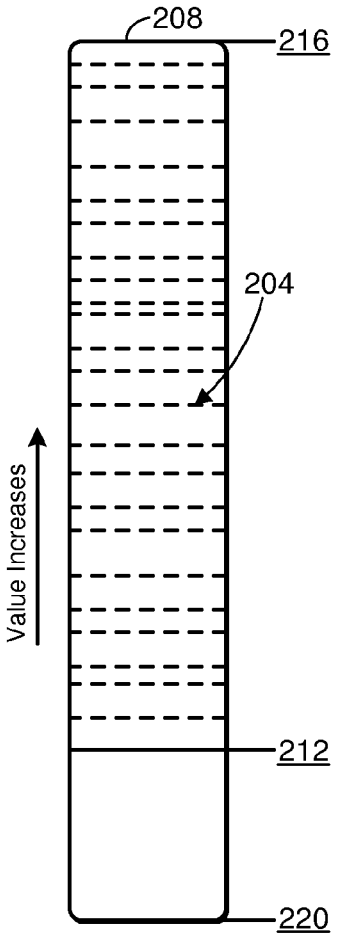
FIG. 2A is a block diagram illustrating an exemplary mystery-bingo jackpot.
Figure 2B:
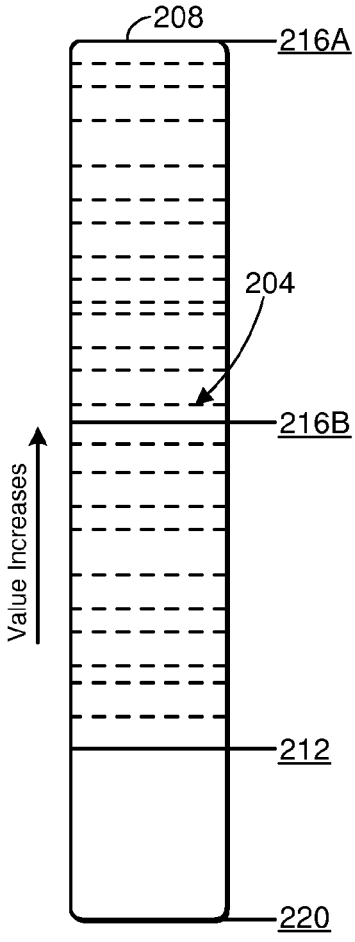
FIG. 2B is a block diagram illustrating an exemplary mystery-bingo jackpot.

FIGS. 2A-2B illustrate mystery-bingo jackpots 208 as a vertical bar. As a mystery-bingo jackpot 208 is incremented (i.e., funded) its value increases from the bottom to the top of the vertical bar, where there may be an upper limit 216. FIGS. 2A-2B show a base amount 220, lower limit 212 and upper limit 216 of exemplary mystery-bingo jackpots 208 for instance.

In one embodiment, the controller 108 may be configured to select up to 75 values between the lower limit 212 and upper limit 216. These values will typically be randomly selected. There may be fewer or additional values selected by the controller 108, such as to ensure that a winning outcome occurs (and the jackpot paid out) before an upper limit 216 of the mystery-bingo jackpot 208 is reached. This may depend on the number of spots present on the global bingo card. In some embodiments, such as shown in FIG. 2B, the number of trigger values 204 may be set to ensure each of multiple mystery-bingo jackpots 208 is awarded before their respective upper limit 216A,216B is reached.

As the name implies, each trigger value 204, may be a trigger that causes a bingo ball to be drawn. In one embodiment, a specific bingo ball number (which may include a letter) may be randomly assigned to each of the 75 trigger values 204 chosen by the controller 108. When the jackpot pool meets or exceeds any of the trigger values 204 as a result of a player's wager, that player wins a ball draw. If the associated bingo ball number is present on the global bingo card 120, that spot on the global bingo card may be marked. For example, a bingo ball graphic or other representation may be positioned in the spot to indicate that it has been marked.

Alternatively, instead of assigning bingo ball numbers to the trigger values 204, it is contemplated that the controller 108 may randomly choose from an available pool of remaining bingo balls when the jackpot pool increases such that it meets or exceeds one of the trigger values. In this case too, a spot on the global bingo card 120 may be marked if such spot matches the number of the drawn bingo ball. In some embodiments, an actual physical bingo ball draw may occur. In other embodiments, the bingo ball draw may be performed electronically, such as by using a random number generator of the mystery-bingo jackpot controller 108 or other gaming device to randomly select a bingo ball.

In one or more embodiments, the ball draw may be made with a great deal of player fan fare, such as by providing one or more visual and or audio presentations. For example, the base game may be suspended, and the player may be asked to initiate the bingo ball draw using a button, touch screen, or other input. In one embodiment, the process of activating the bingo ball draw may be transformed into a player choice. For example, a video game screen may be populated with a set of pictures, symbols or icons, and the player then chooses from the set of symbols which mask, or hide, the actual ball draw choice, but provides a means of choice by the player. In another embodiment, the player may actually choose from a limited set of actual balls, or all balls, for instance (i.e., an unmasked option).

It is contemplated that, a smaller progressive or fixed prize could be awarded when any ball draw opportunity is awarded. In one embodiment, the summation of fixed prizes is counted towards (i.e., summed with) base jackpot value when determining the payback of the system. This adds to the fan fare of obtaining a ball draw. In addition, one or more of the ball draw events (i.e., trigger values) can be associated with mid-sized cash awards, or other special bonuses. This means the ball draw event itself can be associated with the possibility of receiving a mid-sized bonus payment.

The trigger values 204 may be distributed in various ways. As stated the trigger values 204 may be randomly selected between a lower limit 212 and one or more upper limits 216. Typically, the trigger values 204 will be distributed within each set of lower and upper limits 212,216 such that a winning outcome occurs before each upper limit 216 is reached.

Each trigger value 204 may be used in succession towards completion of a winning outcome on the global bingo card. This occurs as the mystery-bingo jackpot's value increases due to funding from wagers placed at its base games. As the value of the mystery-bingo jackpot increases to meet or exceed each triggering value 204, a new bingo ball may be drawn. As bingo balls are drawn, the global bingo card 120 becomes filled. A winning outcome will be obtained as this process continues.

The player whose ball draw completes a winning outcome will be awarded an associated mystery-bingo jackpot award. A bonus pay signal may be transmitted from the controller 108 to the winning player's base game (such as at a gaming machine 100) to notify the player of his or her jackpot win. The controller 108 may then reset the mystery-bingo jackpot by resetting the amount of the jackpot to a pre-determined base amount 220. The controller may then randomly select 75 trigger values for the next jackpot. In cases where multiple upper limits 216 are provided, such as shown in FIG. 2B, the mystery-bingo jackpot 208 need not be reset until a jackpot award associated with the largest upper limit 216 is awarded.

In one embodiment, a bingo game outcome may require up to 25 specific balls (such as to cover a 5×5 global bingo card 120), which in most cases, will likely occur after a number of ball draws. This means the jackpot would tend to be awarded later in the progressive jackpot cycle. However, a winning outcome will be guaranteed to occur before the jackpot award reaches the "must hit by" amount (i.e., the upper limit 216), since all ball draw triggers are selected by the controller 108 to occur before the jackpot amount reaches the upper limit 216.

This allows the display 104 to prominently show that the progressive jackpot "must hit by" a particular upper limit 216. Players will then be aware that, in many cases, the jackpot will nearly reach the upper limit 216, but will always be awarded before it does. In this manner, the mystery-bingo jackpot is as effective in enticing players to its base game as a traditional mystery jackpot, while being triggered by a game of bingo (or other Class-II game).

The mystery-bingo jackpot may support a single mystery-bingo jackpot or multiple mystery-bingo jackpots (along with various other progressive or fixed jackpots if desired). Referring back to FIG. 1A for example, a single shared global bingo card 120 and single set of shared bingo balls are used to provide a single mystery-bingo jackpot for the "all squares covered" winning outcome. This can be seen by the fact that the "all squares covered" outcome is the only one with a "must hit by" value.

It is noted that the largest progressive award may be associated with the least likely winning outcome, which in this example is the "all squares covered" outcome. With the mystery-bingo jackpot, because all bingo ball selections are typically triggered before the progressive jackpot reaches an upper limit, (which is set to $10,000 in the example of FIG. 1A) the mystery-bingo jackpot is guaranteed to be awarded before it hits $10,000.

The other two progressive jackpots shown in FIG. 1A (for a "cross" or "four corners" winning outcome) do not have a "must hit by" value in this example. This means they may hit at any time, though will hit prior to or at the same time as the "all squares covered" outcome since the "all squares covered" outcome requires all of the global bingo card's spots 124 to be marked.

Two fixed jackpots are also offered in the example of FIG. 1A. A first for any line outcome (forming a line of balls, either horizontal or vertical), and a second for placing a ball on the board (since of the 75 possible balls, only 25 are placed). The number of fixed awards are pre-determined in this case, and the cost are also known, so funding for these non-progressing jackpots can be grouped into the overall base jackpot value for the mystery jackpot cycle.

FIG. 1B shows a similar game display board as FIG. 1A, except that the embodiment of FIG. 1B provides multiple mystery-bingo jackpots. This can be seen because several of the jackpots have a "must hit by" limit. It is noted that as each mystery-bingo jackpot is awarded, it will typically be deactivated until it is reset (such as at the end of a payout cycle). Various deactivation indicators, such as un-highlighting, or graying out the mystery-bingo jackpot may be used to signify it has already been awarded and not available for winning.

In some embodiments, a mystery-bingo jackpot may not be indicated as active until it can be won by the players. For example, when the mystery-bingo jackpot's value is between its lower limit and base amount, the mystery-bingo jackpot continues to increment, but cannot be won. In this case, the system grays out or otherwise indicates that the mystery-bingo jackpot is not currently eligible to be won. When the mystery-bingo jackpot is eligible to be won, such as when its value increases to or beyond the lower limit, the mystery-bingo jackpot may be indicated as active.

In one embodiment, the controller 108 may allow the operator the option to group the bingo balls forming the game outcome of individual mystery-bingo jackpots together, thereby forcing the controller 108 to select all values associated with such balls under a pre-selected maximum threshold (i.e., upper limit) specific to that mystery-bingo jackpot. For example, in the case of our example, the controller 108 guarantees that all bingo balls forming the "cross" outcome may be placed on the global bingo card 120, before the upper limit of that jackpot reaches $2,000 dollars. The controller 108 may be configured to select random trigger values only in the range set by the lower and upper limit of that particular jackpot. In this way, the jackpot's winning outcome will occur before the upper limit is reached. Therefore, it is possible to place a "must hit by" indicator alongside each one of multiple mystery-bingo jackpots. It is contemplated that the controller 108 may accept multiple lower and upper limits during configuration to support multiple mystery-bingo jackpots.

In another embodiment, the controller 108 may make a fair placement (evenly distributed in terms of random distribution) of trigger values between the lower and upper limit of the largest of the mystery-bingo jackpots. Because the controller 108 also generates the global bingo card 120, and associates the bingo ball numbers to the trigger values beforehand, the controller can determine the actual "must hit by" value for each supported jackpot.

This value can be electronically transmitted for presentation alongside a mystery-bingo jackpot's award, such as on a display 104 and/or on individual gaming machines or devices. In other words, since the controller 108 pre-determines the trigger values and bingo ball number associations beforehand, it can also calculate, by inspection, the specific "must hit by" value for each mystery-bingo jackpot.

It is contemplated that the configuration mechanism or routine within the controller 108, may be configured to preselect fair balls, trial by trial, until basic jackpot configuration parameters are satisfied. Stated another way, the controller 108 may repeatedly generate random distributions of trigger values and associated bingo ball numbers, until a preselected desired mystery-bingo jackpot is obtained. To illustrate further, in one exemplary embodiment, an operator may select a desired must hit by upper limit (or range of upper limits) and the controller 108 may repeatedly generate trigger values and associated bingo ball numbers until a mystery-bingo jackpot having such upper limit is successfully generated.

In another embodiment, multiple bingo cards may be shared among all players. Each of the shared bingo cards supports its own independent, shared ball draw. Each card supports its own lower and upper limit for which trigger values will be selected, and hence bingo ball numbers will be generated. Supporting a plurality of shared bingo cards allows each bingo card to support its own set of bonusing criteria, which is apart from any other card. Multiple global bingo cards can support their own separate ball draws, where the central bonus controller tracks the ball draw for each card separately and independently.

Figure 3:
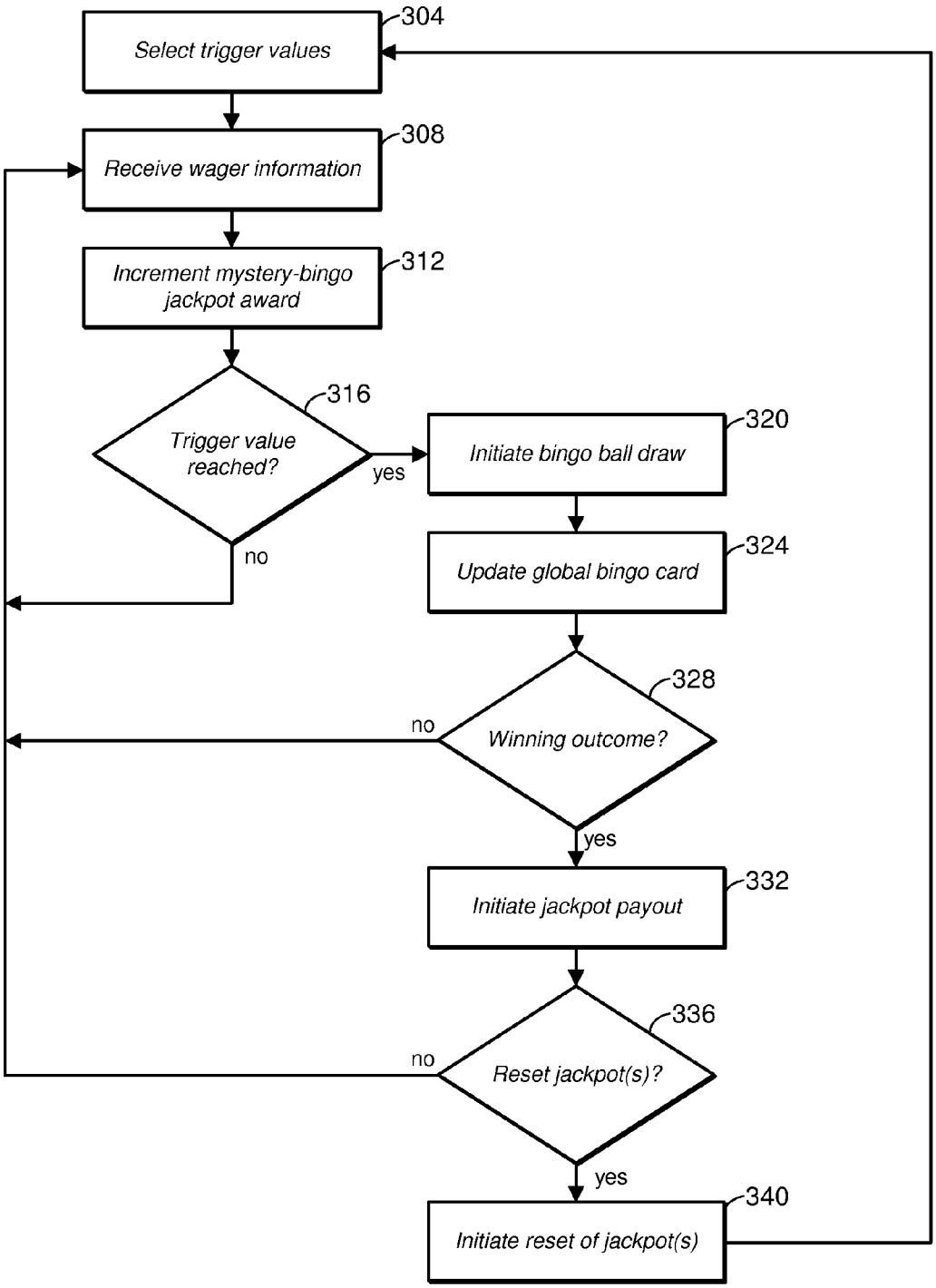
FIG. 3 is a flow diagram illustrating operation of an exemplary mystery-bingo jackpot system.

Further details regarding the operation of the mystery-bingo jackpot system will now be described with regard to the flow diagram of FIG. 3. In one or more embodiments, the operational process disclosed may be performed by the mystery-bingo jackpot controller, which may be a standalone controller, a gaming server, or a gaming machine or other gaming device.

At a step 304, a plurality of trigger values between a lower and upper limit may be randomly selected. As disclosed above for example, 75 trigger values may be randomly selected, though it is contemplated that various numbers of trigger values may be selected. In one or more embodiments, the number of trigger values may depend on the configuration of the global bingo card. For example, 75 trigger values may be sufficient to generate a winning outcome on a global bingo card of a 5×5 configuration (i.e., having 25 spots). Fewer or more trigger values may be randomly selected if the global bingo card has fewer or additional spots. This ensures a winning outcome before the upper limit is reached regardless of the number of spots on the global bingo card.

At a step 308, wager information may be received. Typically the wager information will indicate a wager or funding value. For example, the wager information may be the amount of a wager or a portion of the wager. This value may be used to increment a mystery-bingo jackpot. The wager information may be received from the base games associated with the mystery-bingo jackpot. For example, wager information may be generated at one or more gaming machines. The wager information may indicate the value of a wager or a portion thereof that has been received by a currency acceptor associated with the gaming machine.

If the value of the entire wager placed at the gaming machine is received, the controller may determine how much of the wager to use to increment the mystery-bingo jackpot. Alternatively, the gaming machines may determine this and generate wager information indicating the portion of the wager to be used to increment the mystery-bingo jackpot. The amount of a wager to be used to increment the mystery-bingo jackpot may be defined by an increment rate. This may be defined as a percentage of each wager for example. It is noted that some or all of every wager may be used to increment the mystery-bingo jackpot, regardless of its size. In this manner, every player that makes a wager qualifies for the mystery-bingo jackpot.

In some embodiments however, only wagers of at least a particular threshold value may qualify the player for the mystery-bingo jackpot. Unqualified wagers would not increment the mystery-bingo jackpot and thus would not trigger a bingo ball draw. Other options for qualifying for a chance at triggering a ball draw event for each include 1) making increasingly larger, or eligible wagers on the underlying game, and 2) buying opportunities via a side wager bet, and 3) winning bingo card opportunities during a bonus round.

At a step 312, the mystery-bingo jackpot may be incremented based on or with the value provided in the wager information. At a decision step 316, it may be determined if this increase to the mystery-bingo jackpot has caused the value of the jackpot to reach (i.e., equal) one of the trigger values. If not, the controller may return to step 308 to receive additional wager information. If a trigger value has been reached (or exceeded in some embodiments), then a bingo ball draw may be conducted at a step 320.

The bingo ball draw may occur in various ways. In some embodiments, bingo ball numbers may have been previously randomly associated with each trigger value. In such embodiments, the bingo ball draw may occur by simply accessing or reading the trigger value's associated bingo ball number. In other embodiments, an actual physical or an electronic bingo ball draw may occur, such as by randomly selecting a bingo ball from a pool of bingo balls. Typically, the selected bingo ball will be removed from the pool so that it may not be selected again. If a physical bingo ball draw is used, the apparatus used or such draw may comprise an electronic interface or reporting which bingo ball has been selected, such as by transmitting the number of the selected bingo ball. Alternatively, an operator may read the number from the selected bingo ball and input the number into the controller.

At a step 324, the status of the global bingo card may be updated by marking any spot or spots on the global bingo card having a number that matches the selected bingo ball. For example, if the selected bingo ball is numbered "B37", any spots labeled "B37" may be marked on the global bingo card. In this way the selected bingo ball number is included or incorporated into the global bingo card.

At a decision step 328, it may be determined if the updated global bingo card now has a winning outcome. In general, this will occur by comparing the current state of the global bingo card to the predefined winning outcomes of the mystery-bingo jackpot. Referring to FIG. 1 for example, the winning outcomes include specific patterns of markings on the global bingo card, such as full coverage, a cross, four corners, any line (horizontal, vertical, or diagonal), and/or any placed or matching bingo ball. Various other winning outcomes may be defined as well.

If the global bingo card has marked spots that match a winning outcome, a winning outcome has occurred. If not, a winning outcome has not occurred and the process may return to step 308, where additional wager information may be received as players continue to play the mystery-bingo jackpot's base games.

A winning outcome may be paid out at a step 332. The controller may transmit a signal to the winning player's gaming machine to indicate that the player has won the mystery-bingo jackpot, and to payout the corresponding currency or credits. The player's gaming machine may issue payment electronically, via a coin dispenser or ticket printer, or other payout mechanism. Payment or payout could also be in the form of a prize. It is contemplated that a notification or alert may also be emitted from a public display of the mystery-jackpot controller. Such notification may include one or more audio and/or visual elements.

Once a payout has been made, it may be determined at a decision step 336, whether or not to reset the mystery-bingo jackpot. In general, resetting the mystery-bingo jackpot results in setting the jackpot award to a base amount, which may but need not be zero. This may occur at step 340.

In embodiments having a single mystery-bingo jackpot (i.e., a single upper limit), the mystery-bingo jackpot may be reset each time it is won. It is noted that decision step 336 may not be provided in such embodiments. In embodiments having multiple mystery-bingo jackpot awards (i.e., multiple upper limits), the mystery-bingo jackpot need not be reset after each win. For example, multiple upper limits may be set. The mystery-bingo jackpot may not be reset until an award associated with the largest of the upper limits is won thus completing a bonus cycle. Once reset, a new set of trigger values 304 may be randomly selected at step 304.

It is noted that determination of winning outcomes for other jackpots, such as progressive or fixed jackpots may also occur. For example, at decision step 328, the global bingo card may be compared to winning outcomes for these other jackpots. If a winning outcome has occurred, the award for these jackpots may be paid out at step 332 as well.

Figure 4:
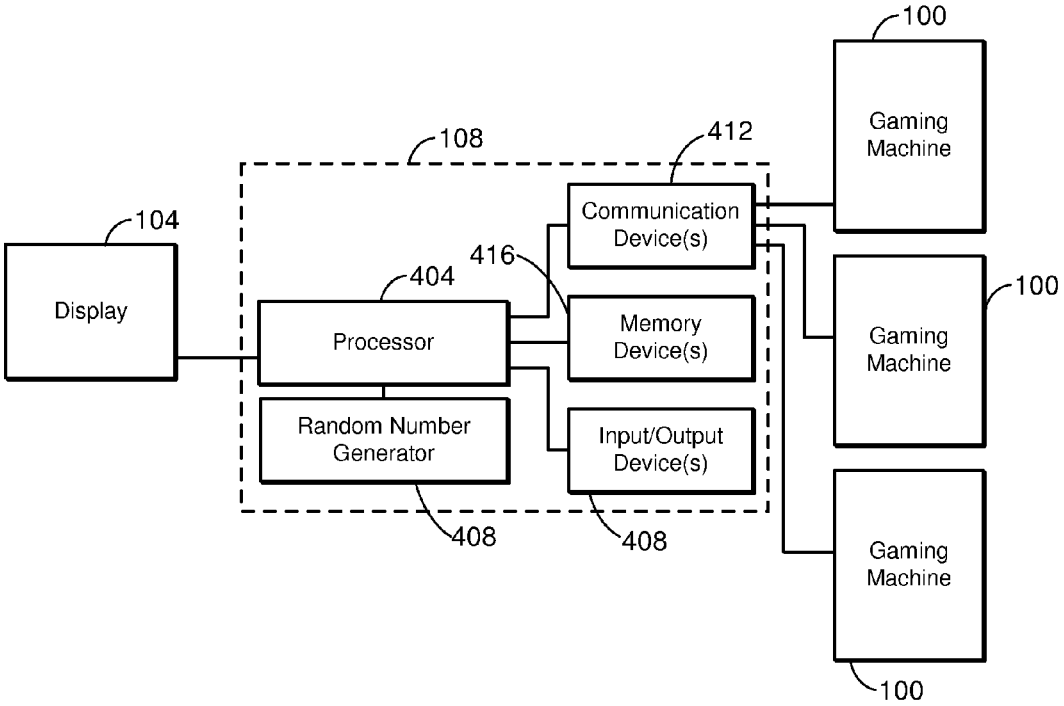
FIG. 4 is a block diagram illustrating an exemplary mystery-bingo jackpot controller.

FIG. 4 is a block diagram illustrating an exemplary controller 108 for the mystery-bingo jackpot. As stated, the controller 108 may be a standalone controller, or be implemented via a gaming server, gaming machine, or other gaming device. As can be seen, the controller 108 may comprise a processor 404 configured to execute various instructions to provide the functionality disclosed herein. In one or more embodiments, the processor 404 may execute instructions in the form of machine readable code. Such machine readable code may define operation of the controller. The machine readable code may be stored on a memory device 416, be hardwired into the processor 404, or both. In one or more embodiments, the processor 404 may be an integrated circuit, microprocessor, or the like. Multiple processors 404 may be used for various tasks, to increase speed, or for redundancy in some embodiments.

For example, in an exemplary circumstance, an operator may input configuration and other information to customize the progressive layout by selecting the desired winning outcomes. The display and system is thus responsive to the operator's desire to add or modify the various winning outcomes upon initial configuration. This provides a jackpot that the operator may customize as desired, such as to entice players. In addition, the inputted winning outcomes may be retrieved or otherwise used when the mystery-bingo jackpot is reset (such as when a jackpot is won). For example, inputted winning outcomes may be the winning outcomes presented on the system's display (upon initial configuration or after a reset) so that players can play to achieve these outcomes to win a jackpot payout.

In operation, the processor 404 may accept input, such as configuration settings, wager information, and other information, process the input and provide an output. The output may be some or all the information presented on a display 104. For example, the status of the global bingo card, jackpot award amounts, or other information may be outputs.

It is contemplated that the controller 108 may have one or more memory devices 416. In addition or instead of storing machine readable code, it is noted that a memory device 416 may store various information related to the mystery-bingo jackpot. For example, a memory device 416 may store lower and upper limits, base amounts, the current value of a mystery-bingo jackpot, and/or one or more triggering values. In addition, a memory device 416 may store selected and unselected bingo ball numbers. Wager information could also be stored. Various memory devices 416 may be used. For example, a memory device 416 may be RAM, flash memory, ROM, magnetic media, optical media or other storage technology.

The controller 108 may also include one or more communications devices 412 or communicating with external and/or remote devices, such as the gaming machines 100 shown in FIG. 4. It is contemplated that a communication device 412 may communicate via a wired or wireless connection. In one or more embodiments, wager information may be shared between the gaming machines 100 and the controller 108 via a communication device 412. In addition, it is contemplated that a communication device 416 may be used to configure the controller with an external device, such as described above. The controller 108 could also or alternatively have one or more input/output devices to allow users to interact with the controller, such as to configure the controller.

One or more random number generators 408 may be included as well. A random number generator 408 may be used to select trigger values and/or bingo balls randomly. In embodiments configured to do so, a random number generator 408 may randomly associate bingo ball numbers with the trigger values. It is noted that the random number generator 408 may be a separate component or may be built in to another component, such as the processor 404. In some embodiments, the random number generator 408 may be external and remote from the controller 108. For example, random numbers (or the trigger values and bingo ball numbers themselves) may be supplied by an external device, such as a gaming server or a physical bingo ball draw apparatus.

Many variations are possible with the systems and methods disclosed herein. In one variation, a plurality of global bingo cards may be displayed, each associated with its own award. Options for qualifying for a chance at triggering a ball draw event for each bingo card include 1) making increasingly larger, or eligible wagers on the underlying game, and 2) buying opportunities via a side wager bet, and 3) winning bingo card opportunities during a bonus round.

Alternatively, a plurality of mystery-bingo jackpot pools may each be associated with a specific winning outcome on one global bingo card. For instance, a horizontal straight line outcome may be paid from one funding pool, while a four corner square pattern may pay from another funding pool. In one embodiment, all bingo balls may be made available until the end of a mystery award cycle, such that bingo balls used to complete a less probable winning outcome will persist and be available to complete another less probable winning outcome. This is highly advantageous, since the largest mystery-bingo jackpots tend to be associated with the least probable winning outcomes, and such outcomes are more likely, even guaranteed, to occur at or near the end of a bonus cycle. It can be expected however that the mystery-bingo jackpots will be generally awarded in order, from smallest to largest during a bonus cycle.

In one embodiment, each mystery-bingo jackpot may be associated with its own increment rate setting. Furthermore, mystery-bingo jackpot payouts may be triggered using one shared set of trigger values (each associated with a ball draw), or each mystery-bingo jackpot may employ its own set of trigger values and associated bingo ball draws. In the case of using a shared set of balls, a single shared configuration of base value, low limit and high limit may be used to establish an overall bonus game cycle. In the case of using separate balls sets (i.e. separate secret values) for each jackpot or subset of jackpots, a separate set of configuration settings may be used for each jackpot or subset of jackpots. In this latter case, each jackpot pool will generally provide its own bonus game cycle.

In another embodiment, the jackpot need not be based on bingo, but may be based on some other game, such as five card poker. For example, a 52 card deck can be represented using 52 trigger values arranged between a lower limit and an upper limit. In one embodiment, these trigger values are randomly selected, using a randomizing element with even probability of distribution within that range. Jackpot values are assigned to common five card poker outcomes, such as straight, flush, four of a kind, royal flush, etc. As the trigger values are encountered as the jackpot value increases, the associated cards are displayed on a public display. The person obtaining the card which completes the first occurrence of a winning hand, wins that jackpot. For example, the first player to draw a card which completes a royal flush may win the largest jackpot. Similar to a bingo ball draw, a card draw may occur when a player's wager increments the jackpot value to equal or exceed a trigger value. It is contemplated that a player may be offered the chance to randomly select the card from a plurality of symbols.

In another playing card or poker embodiment, each jackpot pool may contain its own set of trigger values, each associated with a card, or other indices. A wager pushing the jackpot value to meet or exceed the trigger value causes the system to award the player a card draw. In this embodiment, the card draw is specific to a particular winning hand. If a drawn card completes a winning poker hand, the jackpot may be awarded. Otherwise, the card remains with the group of previously drawn cards until a winner is determined. The system may be seeded with some "starting" cards to maintain player interest at the beginning of the bonus cycle.

In another embodiment, all cards may be global, and may be applied to any jackpot type, or poker game outcome. In this case, previously drawn cards are continuously in display and remain in play. When a player draws a card which completes a winning hand, those cards may be removed from the display. In this manner, the least likely game outcomes remain least likely and the most likely game outcomes occur first on average. The system also ensures that enough cards are preselected at the beginning of the bonus game cycle to cover all game outcomes associated with pending jackpots. In this embodiment, fixed awards can be given to smaller poker hand outcomes.

In one embodiment, the system regulates the number of awards and the number of card draws in such a manner as to ensure the eventual outcome of each jackpot. In another embodiment, any non-winning jackpots, i.e., associated to non occurring poker hands, are saved and added into the associated jackpot for the next bonus cycle. In this case, the "must hit by" value is generated by the system considers the new higher starting value.

In one embodiment, a special set of trigger values are randomly selected along the range; likewise, a specific card is associated to each trigger value. In this case, not all 52 cards may be represented; however, a set of cards is pre-selected which will not interfere with the probability of another poker hand outcome. For example, the cards for a straight and a flush are defined and preselected; the cards have been selected so they cannot coincide to create any other outcome than the two intended outcomes.

While various embodiments of the invention have been described, it will be apparent to those of ordinary skill in the art that many more embodiments and implementations are possible that are within the scope of this invention. In addition, the various features, elements, and embodiments described herein may be claimed or combined in any combination or arrangement.

What is claimed is:

1. A mystery-bingo jackpot controller comprising:

one or more memory devices storing a jackpot award amount, a winning outcome, and an upper limit, and a lower limit;

one or more random number generators configured to generate a plurality of trigger values between the upper limit and the lower limit; and one or more processors configured to:

increment the jackpot award amount a particular amount;

update a global bingo card with a drawn bingo ball number if the jackpot award amount meets or exceeds one of the plurality of trigger values;

compare the updated global bingo card to the winning outcome; and initiate a payout of the jackpot award amount if the updated global bingo card contains the winning outcome;

wherein the quantity of trigger values is set such that the winning outcome must occur before the jackpot award amount reaches the upper limit;

wherein the one or more processors are further configured to associate a bingo ball number with each of the plurality of trigger values, wherein the drawn bingo ball number is the bingo ball number associated with the one of the plurality of trigger values that is met or exceeded.

2. The mystery-bingo jackpot controller of claim 1 further comprising one or more communication devices configured to receive wager information from one or more gaming machines, the wager information indicating the particular amount in which to increment the jackpot award amount.

3. The mystery-bingo jackpot controller of claim 1 further comprising a display configured to present the jackpot award amount, the global bingo card, and the upper limit via one or more electronic screens.

4. The mystery-bingo jackpot controller of claim 1 further comprising a ball draw apparatus configured to randomly select the drawn bingo ball number.

5. The mystery-bingo jackpot controller of claim 1, wherein the one or more processors are configured to reset the jackpot award amount to a predefined base amount if the updated global bingo card contains the winning outcome, the predefined base amount stored in the one or more memory devices.

6. The mystery-bingo jackpot controller of claim 1, wherein the one or more memory devices also store one or more additional winning outcomes having associated jackpot award amounts, wherein the one or more processors are further configured to initiate a payout the associated jackpot award amount when the updated global bingo card contains at least one of the one or more additional winning outcomes.

7. The mystery-bingo jackpot controller of claim 1, wherein the one or more processors are configured to receive input which defines the winning outcome and to store the input as the winning outcome on the one or more memory devices.

8. A mystery-bingo jackpot system comprising:

a display configured to present a global bingo card, a first jackpot award, a first must hit by value, and a first winning outcome, the first winning outcome comprising a set of bingo ball numbers;

a plurality of first trigger values between the first upper limit and the first lower limit;

a plurality of second trigger values between a second upper limit and a second lower limit;

one or more processors configured to:

increment the first jackpot award;

update the global bingo card with a drawn bingo ball number when the first jackpot award meets or exceeds one of the plurality of first or second trigger values;

compare the updated global bingo card to the first winning outcome, wherein the updated global bingo card is presented on the display;

pay the first jackpot award when the updated global bingo card contains the first winning outcome;

increment a second jackpot award;

compare the updated global bingo card to a second winning outcome, the second winning outcome comprising a set of bingo ball numbers; and pay a second jackpot award when the updated global bingo card contains the second winning outcome;

wherein the quantity of first trigger values is set such that the first winning outcome must occur before the first jackpot award amount reaches the first upper limit;

wherein the quantity of second trigger values is set such that the second winning outcome must occur before the second jackpot award amount reaches the second upper limit.

9. The mystery-bingo jackpot system of claim 8, wherein the largest of the plurality of first trigger values defines the first must hit by value.

10. The mystery-bingo jackpot system of claim 8, wherein the display is further configured to present the second upper limit and the second jackpot award.

11. The mystery-bingo jackpot system of claim 8 further comprising one or more gaming machines configured to receive wagers for one or more base games, wherein the one or more gaming machines generate wager information based on the received wagers.

12. The mystery-bingo jackpot system of claim 8 further comprising a bingo ball draw apparatus configured to randomly select bingo ball numbers, wherein the drawn number is one of the randomly selected bingo ball numbers.

13. The mystery-bingo jackpot system of claim 8 further comprising a bingo ball draw apparatus configured to randomly select physical bingo balls, wherein the drawn number is a bingo ball number from one of the randomly selected physical bingo balls.

14. A method for awarding a mystery-bingo jackpot with a jackpot controller comprising:

selecting a plurality of trigger values between a lower limit and an upper limit and storing the plurality of trigger values one or more memory devices of the jackpot controller;

receiving wager information with a communication device, the wager information identifying an increment value;

incrementing the mystery-bingo jackpot's amount by the increment value;

including a drawn bingo ball number in a global bingo card if the amount of the mystery-bingo jackpot meets or exceeds one of the plurality of trigger values;

comparing the global bingo card to a winning outcome; and awarding the amount of the mystery-bingo jackpot if the global bingo card contains the winning outcome;

wherein the quantity of the plurality of trigger values is set such that the winning outcome must occur before the mystery-bingo jackpot's amount reaches the upper limit;

wherein a bingo ball number is associated with each of the plurality of trigger values, and the drawn bingo ball number is the bingo ball number associated with the one of the plurality of trigger values that is met or exceeded.

15. The method of claim 14, wherein the amount of the mystery-bingo jackpot is awarded to a player whose wager caused the amount to meet or exceed the one of the plurality of trigger values.

16. The method of claim 14, wherein the quantity of the plurality of trigger values is set such that the winning outcome must occur before the jackpot award amount reaches the upper limit.

17. The method of claim 14 further comprising receiving the lower limit and the upper limit at the mystery-bingo jackpot controller.

18. The method of claim 14 further comprising displaying the upper limit on a display as a must hit by amount.

19. The method of claim 14 further comprising selecting a plurality of new trigger values between the lower limit and the upper limit and storing the plurality of new trigger values one or more memory devices of the jackpot controller after the mystery-bingo jackpot amount has been awarded.

* * * * *